US007926972B2

(12) United States Patent
Zhang

(10) Patent No.: US 7,926,972 B2
(45) Date of Patent: Apr. 19, 2011

(54) SHOP LIGHT FIXTURE

(76) Inventor: Kanghong Zhang, Torrance, CA (US)

( * ) Notice: Subject to any disclaimer, the term of this patent is extended or adjusted under 35 U.S.C. 154(b) by 212 days.

(21) Appl. No.: 12/319,179

(22) Filed: Jan. 2, 2009

(65) Prior Publication Data

US 2010/0172141 A1 Jul. 8, 2010

(51) Int. Cl.
*F21V 21/00* (2006.01)

(52) U.S. Cl. ..... 362/217.11; 362/217.01; 362/225

(58) Field of Classification Search ..... 362/207.01–217.09, 217.1–217.17, 362/218–225
See application file for complete search history.

(56) References Cited

U.S. PATENT DOCUMENTS

| | | | | | |
|---|---|---|---|---|---|
| 3,240,928 | A | * | 3/1966 | Young | 362/225 |
| 3,293,426 | A | * | 12/1966 | Zagel et al. | 362/221 |
| 3,594,568 | A | * | 7/1971 | Guth, Jr. | 362/221 |
| 3,840,734 | A | * | 10/1974 | Oram | 362/267 |
| 5,588,738 | A | * | 12/1996 | Meoli | 362/184 |
| 6,079,851 | A | * | 6/2000 | Altman et al. | 362/260 |

* cited by examiner

*Primary Examiner* — Julie A Shallenberger
(74) *Attorney, Agent, or Firm* — Clement Cheng

(57) ABSTRACT

A shop light fixture includes reflector. The reflector is of a planar sheet like configuration bent at a left side and a right side. The reflector has a reflector front side and a reflector rear side. A ballast assembly has a ballast front side and a ballast rear side. The ballast front side is mounted to the reflector front side. A first socket and fourth socket are mounted to the ballast front side. A second socket is mounted to the reflector rear side in alignment with the first socket such that the first socket in cooperation with the second socket can receive a first florescent tube. A third socket is mounted to the reflector rear side, and the third socket is electrically connected to the second socket. The third socket and fourth socket receive a second florescent tube.

6 Claims, 1 Drawing Sheet

SHOP LIGHT FIXTURE

FIELD OF THE INVENTION

The present invention relates to florescent tube shop light fixtures.

DISCUSSION OF RELATED ART

A wide variety of florescent light fixtures have been created for general lighting usage. The shop light is the most basic linear florescent tube light available. Typical shop lights have a ballast mounted above the reflector, and have copper wiring extending from the ballast to the florescent light socket such as disclosed in U.S. Pat. No. 5,954,421 to McGrath issued Sep. 21, 1999, the disclosure of which is incorporated herein by reference. The typical shop light is used in a garage, or warehouse where the aesthetic appeal of the light fixture is secondary to its functionality.

Reflectors have also come in a wide variety of configurations, including more expensive aluminum extrusion style florescent reflectors as shown in U.S. Pat. No. 7,144,126 to Mackin issued Dec. 5, 2006, the disclosure of which is incorporated herein by reference. The configuration of the reflectors and the florescent tube lights are nearly endless, and provide a wide variety of different designs for different purposes.

SUMMARY OF THE INVENTION

A shop light fixture includes reflector. The reflector is of a planar sheet like configuration bent at a left side and a right side. The reflector has a reflector front side and a reflector rear side. A ballast assembly has a ballast front side and a ballast rear side. The ballast front side is mounted to the reflector front side. A ballast is mounted inside the ballast assembly. A first socket is mounted to the ballast front side. The first socket is electrically connected to the ballast. A second socket is mounted to the reflector rear side in alignment with the first socket such that the first socket in cooperation with the second socket can receive a first florescent tube. A third socket is mounted to the reflector rear side, and the third socket is electrically connected to the second socket. A fourth socket is mounted to the ballast front side, and the third socket and the fourth socket are in alignment so that the third socket in cooperation with the fourth socket can receive a second florescent tube. The fourth socket is electrically connected to the ballast.

The shop light fixture also has a seal on the ballast assembly. The reflector front side attaches to the seal on the ballast assembly. The seal preferably has a deep groove for receiving the front side of the reflector. The ballast assembly has a trapezoidal profile, and the reflector also has a trapezoidal profile matching with the ballast assembly, and the ballast assembly has a top cover with edges bent inward at a 90° angle to form a pair of bent edges, namely a front bent edge and a rear bent edge. The ballast assembly also has a front cover retained on the front bent edge of the top cover, and a rear cover retained on the rear bent edge of the top cover, and a power cord. The power cord is electrically connected to the ballast and extends through the rear cover of the ballast assembly. Optionally, an end bracket attaches to the rear side of the reflector, so that the end bracket structurally supports the second socket and the third socket.

More specifically, the assembly of the light fixture has a plug connecting to household electric current, and a pull cord switch hanging from the ballast assembly. The plug preferably is grounded and has a ground prong. The ballast assembly is formed in a trapezoidal cross-section shape. The ballast assembly contains a pair of florescent sockets. The reflector has an upper rectangular planar surface and a bottom panel, and also a leading edge. The leading edge of the reflector is the leading end, which mates with a seal of the ballast assembly.

A distal edge defines a distal end, which receives a second pair of florescent sockets. The first and second pair of florescent sockets form a circuit characterized by the first socket in electrical connection with the electronic ballast. The fourth socket is also in electrical connection with the electronic ballast. The second socket is connected to the third socket. The second socket and the first socket receive a first florescent tube between them. The fourth socket and the third socket receive a second florescent tube between them. The florescent tube can be selected from a variety of commonly and commercially available standards.

The end bracket has a pair of openings for attachment to the reflector. The end bracket may snap on, adhere or otherwise bond to the reflector. The end bracket provides structural support to the second socket and the third socket. The second socket and the third socket may be made so that they are integrally formed. Optionally, a wire harness may electrically connect the second socket to the third socket. The wire harness preferably utilizes copper wire. The end bracket can be made in a trapezoidal shape conforming to the distal edge, or the end bracket can have a simple rectangular profile.

The assembly of the florescent light fixture preferably proceeds in three steps. For the first step, a user snaps on the second socket and the third socket onto the reflector. The second socket and the third socket pass through openings in the top of the reflector, and bias snap fit prongs secure for second socket and the third socket to the pair of openings disposed in the top of the reflector. For the second step, the end bracket is then attached to the reflector such as by screws or rivets or adhesive. For the third step, a user inserts the leading edge of the reflector into the seal to provide a firm seal. Alternatively, the leading edge of the reflector can be secured to the ballast by traditional means such as screws or rivets.

The seal has a deep groove, capable of receiving the reflector. The depth of the groove can be sized according to mechanical function and structural requirements.

The front of the ballast assembly mates with the front of the reflector. The ballast assembly includes a top cover that acts as a main housing for the ballast assembly. The top cover receives a backplate through which the electrical plug extends. The top cover receives a seal at a front end. The top cover can be made of metal which has edges bent inward for retaining the backplate and the front plate. Finally, a bottom plate covers the bottom of the ballast assembly.

The first socket and the fourth socket are mounted to the front plate. The electronic ballast is connected to household electric current through the plug apparatus. The electronic ballast has wiring connecting to the first socket and the fourth socket. The front plate is trapezoidal in shape and may be retained inside the top cover which has edges bent inward at a° angle. The seal can be sandwiched between the top cover and the front plate.

The assembly of the ballast may proceed in a few steps. First, the first socket and fourth socket are mounted to the front plate. Secondly, the top cover receives the backplate and the front plate. The ballast is placed inside the top cover and connected to power represented by household electric current plug. A seal is then slipped into position before the bottom cover is attached to the top cover. The ballast is preferably attached to the top cover at the top of the top cover.

The detailed description of the preferred embodiment refers to call out elements that are listed below for reader convenience:

15 Reflector
16 Distal Edge
17 Bottom Panel
18 Leading Edge
20 Ballast Assembly
22 End Bracket
24 Second Socket
25 Third Socket
26 First Socket
27 Fourth Socket
28 Seal
29 Pull Cord Switch
41 Electrical Plug
42 Electronic Ballast
43 Bottom Plate
44 Top Cover
47 Backplate
49 Front Plate

DETAILED DESCRIPTION OF THE PREFERRED EMBODIMENT

Figure 1:
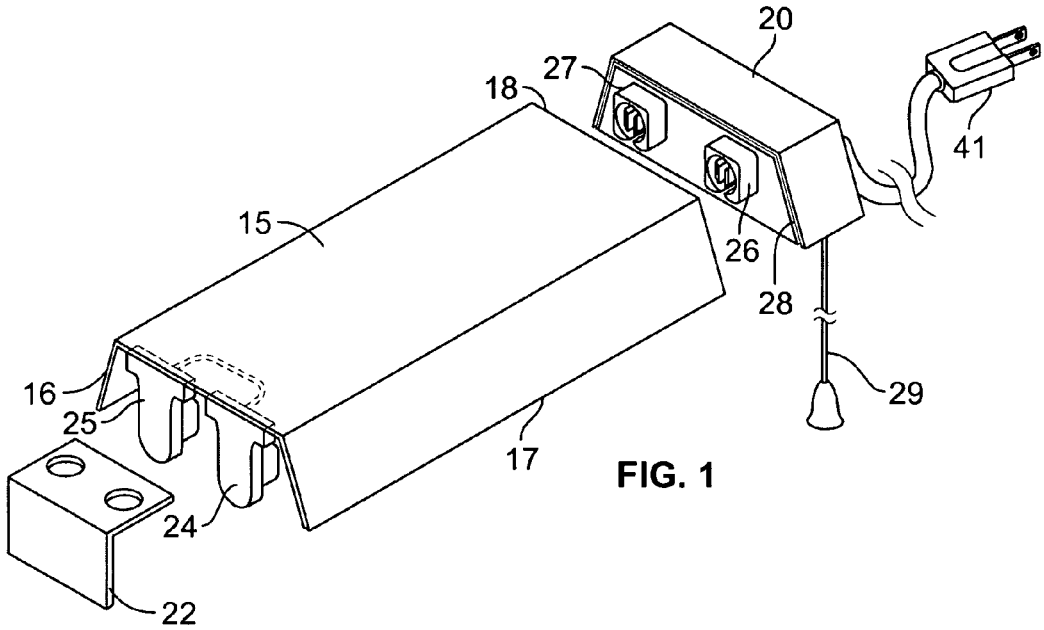
FIG. 1 shows an exploded view diagram of the light fixture.

FIG. 1 shows the assembly of the light fixture which has a plug 41 connecting to household electric current, and a pull cord switch 29 hanging from the ballast assembly 20. The plug preferably is grounded and has a ground prong. The ballast assembly 20 is formed in a trapezoidal cross-section shape. The ballast assembly 20 contains a pair of florescent sockets 26, 27. The reflector 15 has an upper rectangular planar surface and a bottom panel 17, and also a leading edge 18. The leading edge 18 of the reflector 15 is the leading end, which mates with a seal 28 of the ballast assembly 20. The reflector 15 is made of a sheet of metal bent to shape. The total amount of bending is preferably approximately 35° to 65° along a straight linear longitudinal orientation with a best mode of about 45°. The reflector is lightweight and does not have components attached to its top surface.

A distal edge 16 defines a distal end, which receives a second pair of florescent sockets 24, 25. The first and second pair of florescent sockets form a circuit characterized by the first socket 26 in electrical connection with the electronic ballast 42. The fourth socket 27 is also in electrical connection with the electronic ballast 42. The second socket 24 is connected to the third socket 25. The second socket 24 and the first socket 26 receive a first florescent tube between them. The fourth socket 27 and the third socket 25 receive a second florescent tube between them. The florescent tube can be selected from a variety of commonly and commercially available standards such as T12, T8 or T5.

The end bracket 22 has a pair of openings for attachment to the reflector 15. The end bracket 22 may snap on, adhere or otherwise bond to the reflector 15. The end bracket 22 provides structural support to the second socket 24 and the third socket 25. The second socket 24 and the third socket 25 may be made so that they are integrally formed. Optionally, a wire harness may electrically connect the second socket to the third socket. The wire harness preferably utilizes copper wire. The end bracket 22 can be made in a trapezoidal shape conforming to the distal edge 16, or the end bracket 22 can have a simple rectangular profile as shown in FIG. 1.

The assembly of the florescent light fixture preferably proceeds in three steps. For the first step, a user snaps on the second socket 24 and the third socket 25 onto the reflector. The second socket 24 and the third socket 25 pass through openings in the top of the reflector, and bias snap fit prongs secure for second socket 24 and the third socket 25 to the pair of openings disposed in the top of the reflector. For the second step, the end bracket 22 is then attached to the reflector 15 such as by screws or rivets or adhesive. For the third step, a user inserts the leading edge of the reflector 18 into the seal 28 to provide a firm seal. Alternatively, the leading edge of the reflector 18 can be secured to the ballast by traditional means such as screws or rivets.

The seal 28 has a deep groove, capable of receiving the reflector 18. The depth of the groove can be sized according to mechanical function and structural requirements.

Figure 2:
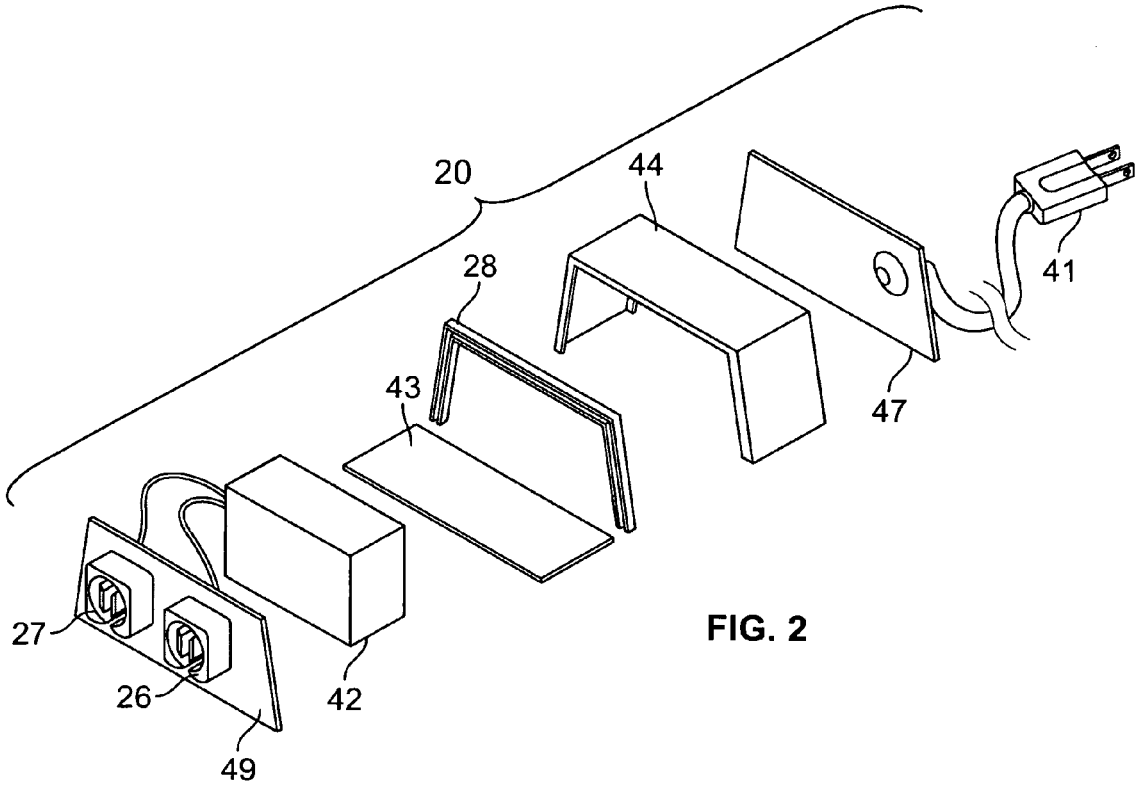
FIG. 2 shows an exploded view diagram of the ballast assembly.

The assembly of the ballast is detailed in FIG. 2. The front of the ballast assembly 20 mates with the front of the reflector 15. The ballast assembly includes a top cover 44 that acts as a main housing for the ballast assembly. The top cover 44 receives a backplate 47 through which the electrical plug 41 extends. The top cover 44 receives a seal 28 at a front end. The top cover 44 can be made of metal which has edges bent inward for retaining the backplate 47 and the front plate 49. Finally, a bottom plate 43 covers the bottom of the ballast assembly 20.

The first socket 26 and the fourth socket 27 are mounted to the front plate 49. The electronic ballast 42 is connected to household electric current through the plug apparatus 41. The electronic ballast has wiring connecting to the first socket 26 and the fourth socket 27. The front plate 49 is trapezoidal in shape and may be retained inside the top cover 44 which has edges bent inward at a 90° angle. The seal 28 can be sandwiched between the top cover 44 and the front plate 49.

The assembly of the ballast may proceed in a few steps. First, the first socket 26 and fourth socket 27 are mounted to the front plate 49. Secondly, the top cover 44 receives the backplate 47 and the front plate 49. The ballast 42 is placed inside the top cover 44 and connected to power represented by household electric current plug 41. A seal 28 is then slipped into position before the bottom cover 43 is attached to the top cover 44. The ballast is preferably attached to the top cover 44 at the top of the top cover 44.

Although the invention has been disclosed in detail with reference only to the preferred embodiments, those skilled in the art will appreciate that various other embodiments can be provided without departing from the scope of the invention. Accordingly, the invention is defined only by the claims set forth below.

The invention claimed is:

1. A shop light fixture comprising:

a. a reflector, wherein the reflector is of planar sheet configuration bent at a left side and a right side, wherein the reflector has a reflector front side and a reflector rear side, b. a ballast assembly having a ballast front side and a ballast rear side, wherein the ballast front side is mounted to the reflector front side;

c. a ballast mounted inside the ballast assembly;

d. a first socket mounted to the ballast front side, wherein the first socket is electrically connected to the ballast;

e. a second socket mounted to the reflector rear side, in alignment with the first socket such that the first socket in cooperation with the second socket can receive a first florescent tube;

f. a third socket mounted to the reflector rear side, wherein the third socket is electrically connected to the second socket;

g. a fourth socket mounted to the ballast front side, wherein the third socket and the fourth socket are in alignment so that the third socket in cooperation with the fourth socket can receive a second florescent tube, wherein the fourth socket is electrically connected to the ballast; wherein the ballast assembly has a top cover with edges bent inward at about a 90° angle to form a front bent edge and a rear bent edge, and further comprising a front cover retained on the front bent edge of the top cover, and further comprising a rear cover retained on the rear bent edge of the top cover.

2. A shop light fixture comprising:

a. a reflector, wherein the reflector is of planar sheet configuration bent at a left side and a right side, wherein the reflector has a reflector front side and a reflector rear side;

b. a ballast assembly having a ballast front side and a ballast rear side, wherein the ballast front side is mounted to the reflector front side;

c. a ballast mounted inside the ballast assembly;

d. a first socket mounted to the ballast front side, wherein the first socket is electrically connected to the ballast;

e. a second socket mounted to the reflector rear side, in alignment with the first socket such that the first socket in cooperation with the second socket can receive a first florescent tube;

f. a third socket mounted to the reflector rear side, wherein the third socket is electrically connected to the second socket;

g. a fourth socket mounted to the ballast front side, wherein the third socket and the fourth socket are in alignment so that the third socket in cooperation with the fourth socket can receive a second florescent tube, wherein the fourth socket is electrically connected to the ballast; wherein the ballast assembly has a trapezoidal profile, wherein the reflector also has a trapezoidal profile matching with the ballast assembly, wherein the ballast assembly has a top cover with edges bent inward at about a 90° angle to form a front bent edge and a rear bent edge, and further comprising a front cover retained on the front bent edge of the top cover, and further comprising a rear cover retained on the rear bent edge of the top cover.

3. A shop light fixture comprising:

a. a reflector, wherein the reflector is of planar sheet configuration bent at a left side and a right side, wherein the reflector has a reflector front side and a reflector rear side;

b. a ballast assembly having a ballast front side and a ballast rear side, wherein the ballast front side is mounted to the reflector front side;

c. a ballast mounted inside the ballast assembly;

d. a first socket mounted to the ballast front side, wherein the first socket is electrically connected to the ballast;

e. a second socket mounted to the reflector rear side, in alignment with the first socket such that the first socket in cooperation with the second socket can receive a first florescent tube;

f. a third socket mounted to the reflector rear side, wherein the third socket is electrically connected to the second socket;

g. a fourth socket mounted to the ballast front side, wherein the third socket and the fourth socket are in alignment so that the third socket in cooperation with the fourth socket can receive a second florescent tube, wherein the fourth socket is electrically connected to the ballast; wherein the ballast assembly has a top cover with edges bent inward at about a 90° angle to form a a front bent edge and a rear bent edge, and further comprising a front cover retained on the front bent edge of the top cover, and further comprising a rear cover retained on the rear bent edge of the top cover, further comprising a power cord, wherein the power cord is electrically connected to the ballast and extends through the rear cover of the ballast assembly.

4. A shop light fixture comprising:

a. a reflector, wherein the reflector is of planar sheet configuration bent at a left side and a right side, wherein the reflector has a reflector front side and a reflector rear side;

b. a ballast assembly having a ballast front side and a ballast rear side, wherein the ballast front side is mounted to the reflector front side;

c. a ballast mounted inside the ballast assembly;

d. a first socket mounted to the ballast front side, wherein the first socket is electrically connected to the ballast;

e. a second socket mounted to the reflector rear side, in alignment with the first socket such that the first socket in cooperation with the second socket can receive a first florescent tube;

f. a third socket mounted to the reflector rear side, wherein the third socket is electrically connected to the second socket;

g. a fourth socket mounted to the ballast front side, wherein the third socket and the fourth socket are in alignment so that the third socket in cooperation with the fourth socket can receive a second florescent tube, wherein the fourth socket is electrically connected to the ballast; wherein the ballast assembly has a trapezoidal profile, wherein the reflector also has a trapezoidal profile matching with the ballast assembly, wherein the ballast assembly has a top cover with edges bent inward at about a 90° angle to form a front bent edge and a rear bent edge, and further comprising a front cover retained on the front bent edge of the top cover, and further comprising a rear cover retained on the rear bent edge of the top cover, further comprising a power cord, wherein the power cord is electrically connected to the ballast and extends through the rear cover of the ballast assembly, further comprising an end bracket attaching to the rear side of the reflector, wherein the end bracket structurally supports the second socket and the third socket.

5. A shop light fixture comprising:

a. a reflector, wherein the reflector is of planar sheet configuration bent at a left side and a right side, wherein the reflector has a reflector front side and a reflector rear side;

b. a ballast assembly having a ballast front side and a ballast rear side, wherein the ballast front side is mounted to the reflector front side;

c. a ballast mounted inside the ballast assembly;

d. a first socket mounted to the ballast front side, wherein the first socket is electrically connected to the ballast;

e. a second socket mounted to the reflector rear side, in alignment with the first socket such that the first socket in cooperation with the second socket can receive a first florescent tube;

f. a third socket mounted to the reflector rear side, wherein the third socket is electrically connected to the second socket;

g. a fourth socket mounted to the ballast front side, wherein the third socket and the fourth socket are in alignment so that the third socket in cooperation with the fourth socket can receive a second florescent tube, wherein the fourth socket is electrically connected to the ballast; further comprising: a seal on the ballast assembly, wherein the reflector front side attaches to the seal on the ballast assembly, wherein the seal has a deep groove for receiving the front side of the reflector, wherein the ballast assembly has a trapezoidal profile, wherein the reflector also has a trapezoidal profile matching with the ballast assembly, wherein the ballast assembly has a top cover with edges bent inward at about a 90° angle to form a front bent edge and a rear bent edge, and further comprising a front cover retained on the front bent edge of the top cover, and further comprising a rear cover retained on the rear bent edge of the top cover.

6. A shop light fixture comprising:

a. a reflector, wherein the reflector is of planar sheet configuration bent at a left side and a right side, wherein the reflector has a reflector front side and a reflector rear side;

b. a ballast assembly having a ballast front side and a ballast rear side, wherein the ballast front side is mounted to the reflector front side;

c. a ballast mounted inside the ballast assembly;

d. a first socket mounted to the ballast front side, wherein the first socket is electrically connected to the ballast;

e. a second socket mounted to the reflector rear side, in alignment with the first socket such that the first socket in cooperation with the second socket can receive a first florescent tube;

f. a third socket mounted to the reflector rear side, wherein the third socket is electrically connected to the second socket;

g. a fourth socket mounted to the ballast front side, wherein the third socket and the fourth socket are in alignment so that the third socket in cooperation with the fourth socket can receive a second florescent tube, wherein the fourth socket is electrically connected to the ballast; further comprising: a seal on the ballast assembly, wherein the reflector front side attaches to the seal on the ballast assembly, wherein the seal has a deep groove for receiving the front side of the reflector, wherein the ballast assembly has a trapezoidal profile, wherein the reflector also has a trapezoidal profile matching with the ballast assembly, wherein the ballast assembly has a top cover with edges bent inward at about a 90° angle to form a front bent edge and a rear bent edge, and further comprising a front cover retained on the front bent edge of the top cover, and further comprising a rear cover retained on the rear bent edge of the top cover, further comprising a power cord, wherein the power cord is electrically connected to the ballast and extends through the rear cover of the ballast assembly, further comprising an end bracket attaching to the rear side of the reflector, wherein the end bracket structurally supports the second socket and the third socket.

* * * * *